United States Patent [19]

Taylor et al.

[11] Patent Number: 4,543,556

[45] Date of Patent: Sep. 24, 1985

[54] INDUCTIVE COUPLER SYSTEMS

[75] Inventors: Douglas R. Taylor, Kent; David W. Pearce, Avon, both of England

[73] Assignee: Marconi Avionics Limited, England

[21] Appl. No.: 633,968

[22] Filed: Jul. 24, 1984

[30] Foreign Application Priority Data

Jul. 29, 1983 [GB] United Kingdom ..... 8320510

[51] Int. Cl.[4] ..... H01F 27/26

[52] U.S. Cl. ..... 336/210; 336/DIG. 2

[58] Field of Search ..... 336/212, 210, 221, DIG. 2, 336/197

[56] References Cited

U.S. PATENT DOCUMENTS 4,038,625 7/1977 Tompkins et al. ..... 336/DIG. 2 X 4,303,902 12/1981 Lesster et al. ..... 336/DIG. 2 X

FOREIGN PATENT DOCUMENTS 1398224 6/1975 United Kingdom ..... 336/DIG. 2

*Primary Examiner*—Thomas J. Kozma

*Attorney, Agent, or Firm*—Kirschstein, Kirschstein, Ottinger & Israel

[57] ABSTRACT

An inductive coupler system including a first part in which is defined a socket region and a second part including a plug member. A first frame member carrying a first magnetic half-core constituting one half of an inductive coupler is supported by the first part, while the second part carries a second magnetic half-core constituting the other half of the inductive coupler. The first part includes actuation means responsive to the insertion of said plug member in said socket region to move the first frame member towards the second part to a position where a mating surface of each of the half-cores are in surface-to-surface alignment with each other. Second actuation means drives the aligned mating surfaces into intimate contact or moves the first frame member away from the second part.

6 Claims, 4 Drawing Figures

INDUCTIVE COUPLER SYSTEMS

This invention relates to inductive coupler systems, and has particular application to inductive coupler systems for use in undersea applications.

Such inductive coupler systems frequently consist of two parts, the first part being connected to a movable surface vessel, and the second part being located on the sea bed. It is then desirable to be able to connect, and disconnect, the two parts on the sea bed under remote control from the surface vessel.

It is an object of the present invention to provide such an inductive coupler system.

According to the present invention an inductive coupler system comprises: a first part in which is defined a socket region, said first part supporting a first frame member which carries a first magnetic half-core constituting one half of an inductive coupler; a second part comprising a plug member adapted to be received by the socket region, said second part incorporating a second frame member which carries a second magnetic half-core constituting the other half of the inductive coupler; first actuation means connected to said first part; and second actuation means connected to said second part, said first actuation means being operable by the insertion of said plug member into said socket region to move said first frame member towards said second frame member to a position where a mating surface of each of said half-cores are in surface-to-surface alignment with each other, said second actuation means being operative in a first sense to drive the aligned mating surfaces into intimate contact, and operable in a second sense to cause said first actuation means to move said first frame member away from said second frame member.

In one particular inductive coupler system in accordance with the invention said first part includes a further frame member which carries a third magnetic half-core constituting one half of a further inductive coupler, said first and further frame members being positioned on opposing sides of said socket region; a fourth magnetic half core constituting the other half of said further inductive coupler is carried by said second frame member with its mating surface on the opposite side of said second frame member to that of the second magnetic half-core; and a further said first actuation means is connected to said mount, said further first actuation means being operable by the insertion of said plug member into said socket region to move said further frame member to a position where a mating surface of said third and fourth half-cores are in surface-to-surface alignment with each other, operation of said second actuation means in said first sense being effective to drive the aligned mating surfaces of said third and fourth magnetic half-cores into intimate contact, and operation of said second actuation means in said second sense being effective to cause said further first actuation means to move said further frame member away from said second frame member.

Preferably the or each of said first actuation means comprises a parallel motion linkage connecting said first or further frame member to said first part, said linkage having a lever arm extending into the path of movement of said plug member into said socket region.

Preferably said second actuation means comprises a hydraulic jack.

One inductive coupler system in accordance with the invention will now be described, by way of example only, with reference to the accompanying drawings in which.

Figure 1:
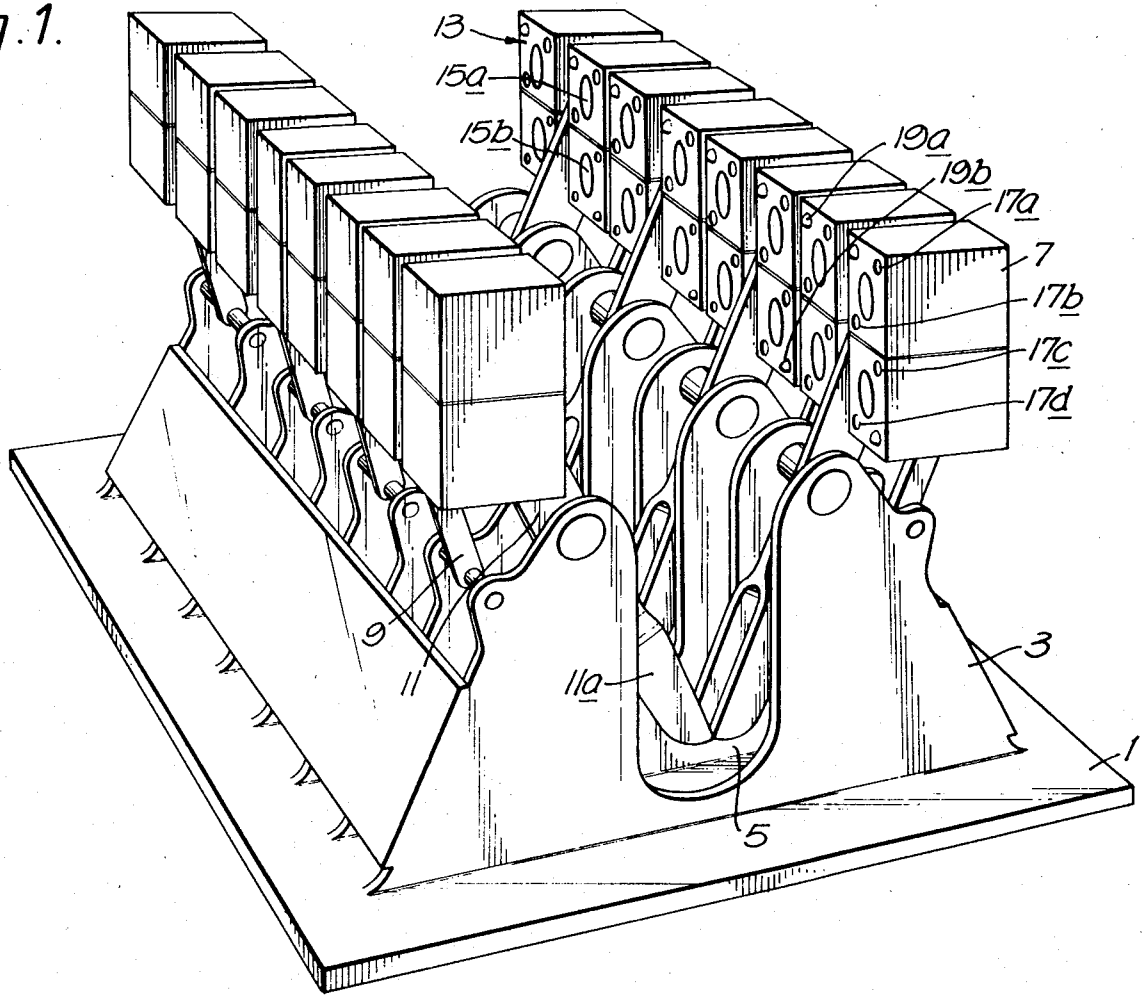
FIG. 1 is a perspective view of a first part of the system.

Referring firstly to FIG. 1 the inductive coupler system includes a first part including a mount 1 secured to a sub-sea oil production system production template (not shown) on the sea bed (not shown). The mount 1 has extending from it eight pairs of flanges 3 arranged in a parallel, spaced configuration in two rows along the mount such that a socket region 5 is defined between the two rows. In respect of each pair of flanges 3 there is provided a pair of frame members 7 arranged side by side, each pair of frame members 7 being moveably connected to the pair of flanges by a parallel motion linkage consisting of two parallel lever arms 9, 11 each pivoted both to the pair of flanges 3 and each pair of frame members 7. The sets of lever arms 9, 11 connected to the flanges 3 in the two rows are set at an angle to each other such that an extension 11*a* on one 11 of each pair of lever arms extends into the socket region 5, and the front faces 13 of the frame members 7 connected to each row of flanges 3 face towards the socket region 5. The end regions 11*b* of the extensions 11*a* within the socket region 5 are of cylindrical formation, in each of which is a channel 11*c* as best seen in FIG. 1. Each frame member 7 supports two maghetic half cores 15*a, b* which each constitutes a first half of a respective inductive coupler, one such coupler being provided in respect of each wellhead (not shown) present on the template. Each frame member 7 also supports a further four magnetic halfcores 17*a, b, c, d* which each constitute a first half of a respective signal coupler. Each magnetic half-core 15*a, b,* 17*a, b, c, d* is spring loaded for movement away from the front face 13 of the respective frame member 7 by a preloaded spring (not shown). Projecting from the front face of each of the frame members 7 are upper and lower dowel pins 19*a,* 19*b*.

Figure 2:
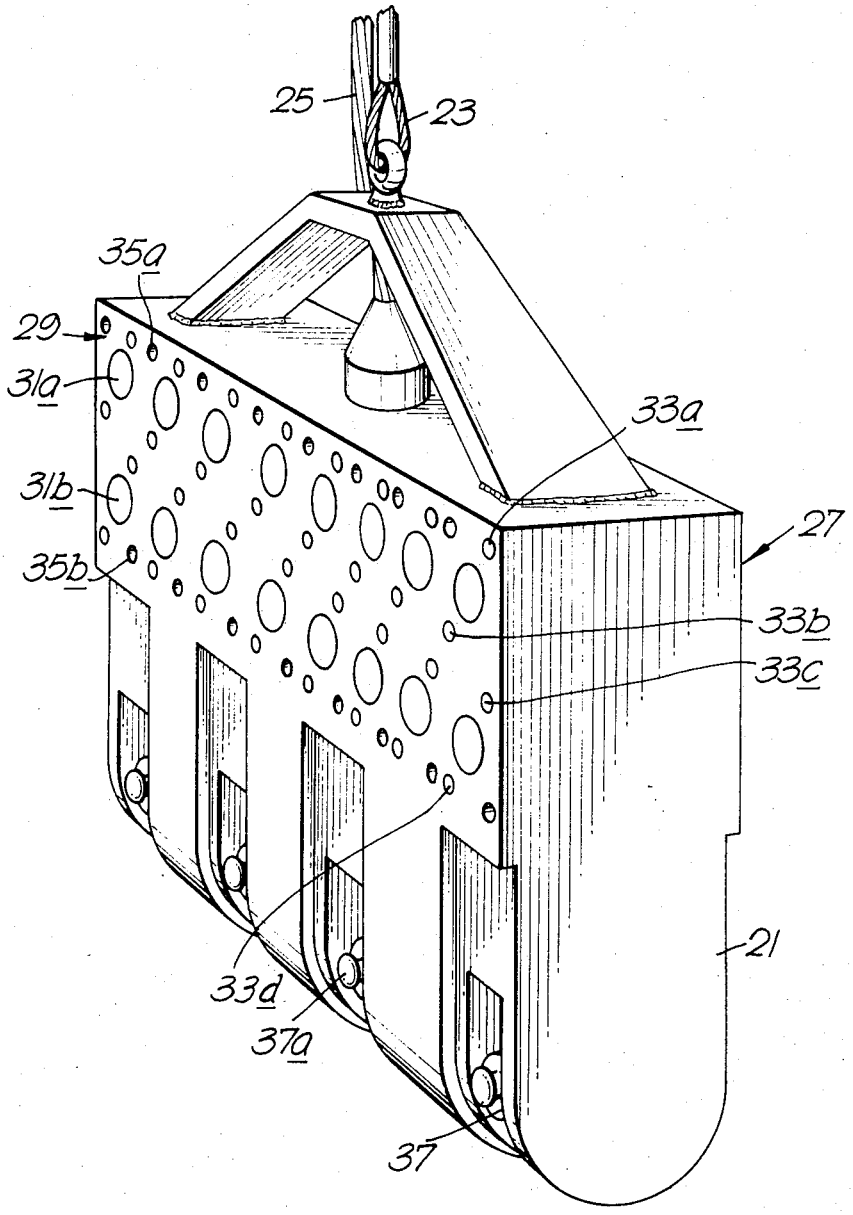
FIG. 2 is a perspective view of a second part of the system.
Figure 3:
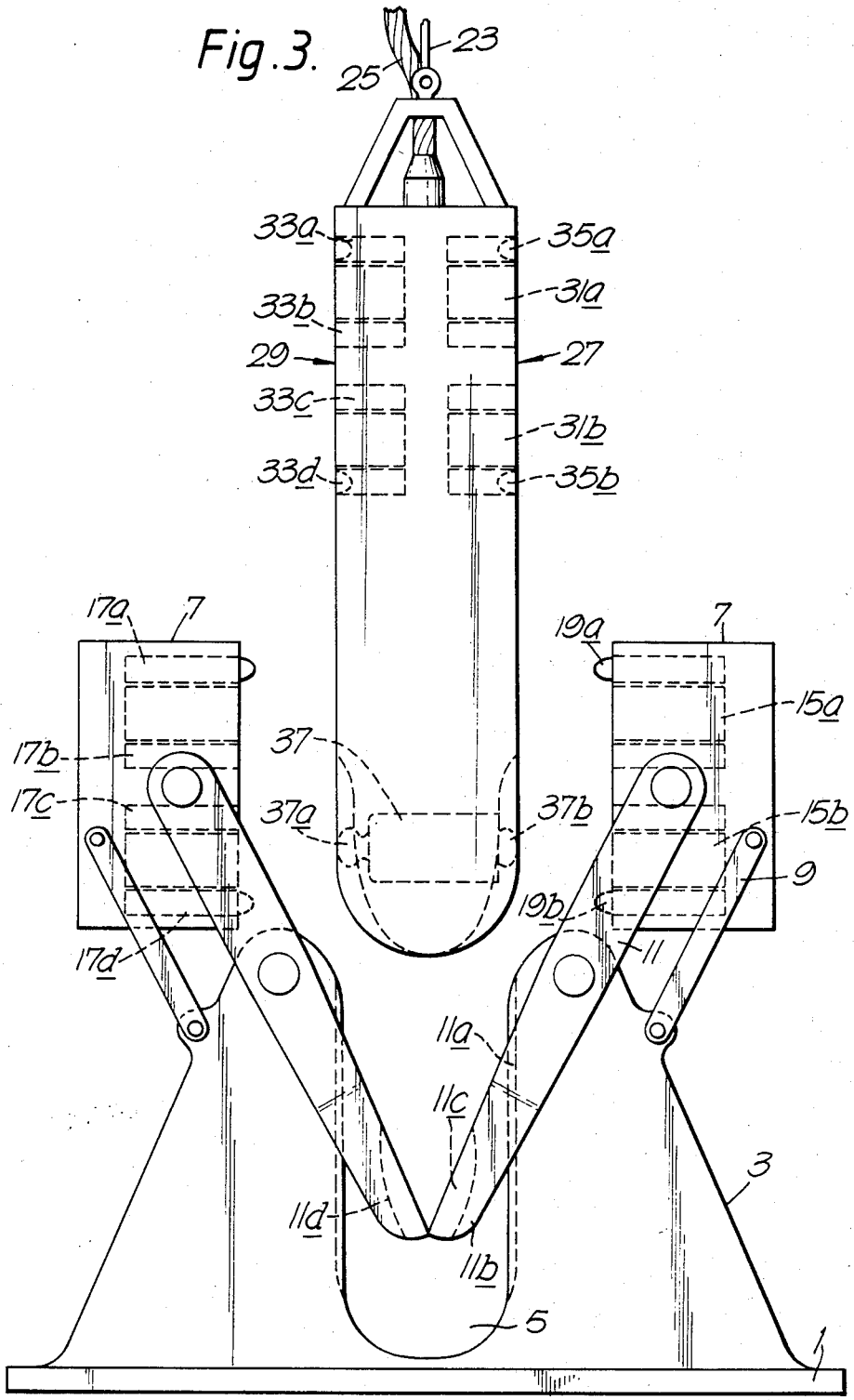
FIG. 3 is a schematic end elevation of the system in a non-operative condition.

Referring now also to FIG. 2, the inductive coupler system further includes a second part including a plug member 21 designed to be received by the socket region 5 defined in the mount 1. The end of the second part remote from the plug member 21 is suspended by a support cable 23 attached to a controlling surface vessel (not shown) such as a semi-submerged floating platform above the mount 1 as shown in FIG. 3. An umbilical cable 25 containing an electrical cable or cables, and a hydraulic conduit is also connected between the plug member 21 and the surface vessel.

Incorporated along each of the two opposing long surfaces 27, 29 of the second part above the plug member 21 are two rows of eight magnetic half-cores 31*a, b,* each half-core constituting a second half of a respective inductive coupler, and four rows of eight magnetic half-cores 33*a, b, c, d* each constituting a second half of a respective signal coupler. Each magnetic half-core 19*a, b,* 33*a, b, c, d* is spring loaded for movement away from the respective surface 27 or 29 by a preloaded spring (not shown). Each surface 27, 29 is also provided with upper and lower rows of indentations 35*a, b.*

Towards the end of the plug member 21 remote from the support cable 23 and umbilical cable 25 are provided four hydraulic jacks 37, each capable of expansion in directions away from the surfaces 27 and 29. At each side of each jack 37 is provided an appendage in the form of a knob 37*a, b.*

Figure 4:
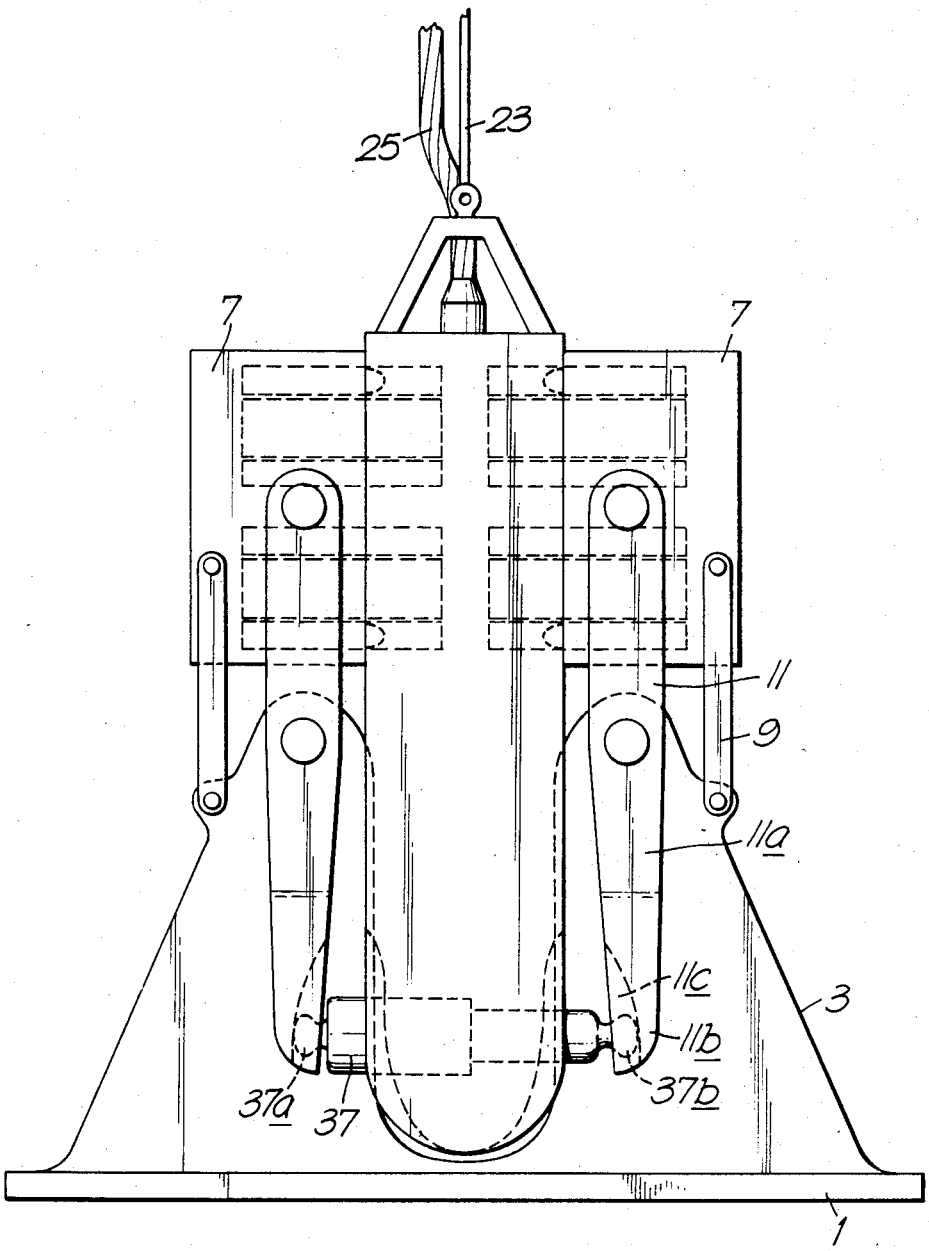
FIG. 4 is a view corresponding to that of FIG. 3 of the system in an operative condition.

In use of the inductive coupler system the second part is suspended above the first part such that the plug member 21 lies above the socket region 5 defined in the mount 1 as shown in FIG. 3. When it is required to effect the coupling of the two halves of the respective inductive couplers and signal couplers, the plug member 21 is lowered into the socket region, the knobs 37*a, b* on each of the jacks 37 entering a respective channel 11*c* in one of the cylindrical regions 11*b* of the extensions 11*a* of the lever arms 11. As the plug member 21 moves further downwards within the socket region 5 towards the position shown in FIG. 4, displacement of the extensions 11*a* by the plug member 21 causes the frame members 7 to swing towards the surfaces 27, 29 of the second part 20. The knobs 37*a, b* finally each reach a shoulder 11*d* in the channels 11*c*, at which point the plug member 21 is prevented from moving further down in the socket region 5. With the plug member 21 in this position, the front surfaces of the half-cores 15*a, b,* 17*a, b c, d* carried by each of the frame members 7 are in face-to-face alignment with half-cores 31*a, b,* 33*a, b, c, d* carried by the second part 20. The dowel pins 19*a, b* extending from the surfaces 13 of the frame members are then in a position to engage the complementary indentations 35*a, b* in the surfaces 27, 29 of the second part 20, thus assuring the alignment of the respective halves of the inductive couplers and signal couplers. Following this alignment the hydraulic jacks 37 are actuated by hydraulic fluid passing through the umbilical cable 25 so as to drive the aligned mating surfaces of the half-cores 19*a,* 31*a;* 19*b,* 31*b;* 17*a,* 33*a;* 17*b,* 33*b;* 17*c,* 33*c* and 17*d,* 33*d* into intimate contact with each other against the bias of the spring loading of each of the half-cores the lever arms 9, 11, then lying in a substantially vertical position. The spring loading of the half-cores ensures the intimate contact of each of the pairs of half-cores within each inductive or signal coupler, even if the mating surfaces of each of the half-cores along each of the surfaces 13 of the two rows of frame members 7, and the two surfaces 27, 29 of the second part 20 do not precisely lie in the same plane.

In order to disconnect the two parts of the coupler system such that for example the surface vessel supporting the second part 20 may move away from the template, the hydraulic jacks 37 are caused to contract, the knobs 37*a, b* pulling the lever arm extensions 11*a* in with them by virtue of their being trapped in the lower ends of the channels 11*a*. The front surfaces 13, together with the respective magnetic half-cores are thus disengaged from the surfaces 27, 29 of the second part 20, the positive pulling action of the jacks 37 overcoming any reluctance of the frames 7 to move due to for example corrosion of any of the dowel pegs 19*a, b* in the complementary indentations 35*a, b* or corrosion of any of the bearings. The plug member 21 may then be lifted out of the socket region 5, the knobs 37*a, b,* sliding out of their respective channels 11*a*. As the plug member 21 is removed from the socket region 5, the weight of the frame members 7 causes them to swing back on the lever arms 9, 11 to the position shown in FIGS. 1 and 3.

We claim:

1. An inductive coupler system comprising: a first part in which is defined a socket region, said first part supporting a first frame member which carries a first magnetic half-core constituting one half of an inductive coupler; a second part comprising a plug member adapted to be received by the socket region, said second part incorporating a second frame member which carries a second magnetic half-core constituting the other half of the inductive coupler; first actuation means connected to said first part; and second actuation means connected to said second part, said first actuation means being operable by the insertion of said plug member into said socket region to move said first frame member towards said second frame member to a position where a mating surface of each of said half-cores are in surface-to-surface alignment with each other, said second actuation means being operative in a first sense to drive the aligned mating surface into intimate contact, and operable in a second sense to cause said first actuation means to move said first frame member away from said second frame member.

2. An inductive coupler system in accordance with claim 1 in which: said first part includes a further frame member which carries a third magnetic half-core constituting one half of a further inductive coupler, said first and further frame members being positioned on opposing sides of said socket region; a fourth magnetic half-core constituting the other half of said further inductive coupler is carried by said second frame member with its mating surface on the opposite side of said second frame member to that of the second magnetic half-core; and a further said first actuation means is connected to a mount, said further first actuation means being operable by the insertion of said plug member into said socket region to move said further frame member to a position where a mating surface of said third and fourth half-cores are in surface-to-surface alignment with each other, operation of said second actuation means in said first sense being effective to drive the aligned mating surfaces of said third and fourth magnetic halfcores into intimate contact, and operation of said second actuation means in said second sense being effective to cause said further first actuation means to move said further frame member away from said second frame member.

3. An inductive coupler system in accordance with claim 1 in which the first actuation means comprises a parallel motion linkage connecting said first frame member to said first part, said linkage having a lever arm extending into the path of movement of said plug member into said socket region.

4. An inductive coupler system in accordance with claim 3 in which said second actuation means comprises a hydraulic jack.

5. An inductive coupler system in accordance with claim 4 in which said jack exerts a positive pulling action on said lever arm on operation of said jack in said second sense.

6. An inductive coupler system in accordance with claim 1 in which at least one of said magnetic half-cores is spring loaded for movement away from its associated frame member.

* * * * *